US011187499B1

(12) United States Patent
Fortney

(10) Patent No.: US 11,187,499 B1
(45) Date of Patent: Nov. 30, 2021

(54) DIRECTIONAL HIGH-ENERGY RADIO FREQUENCY WEAPON

(71) Applicant: Science Applications International Corporation, Reston, VA (US)

(72) Inventor: George G. Fortney, Toms River, NJ (US)

(73) Assignee: Science Applications International Corporation, Reston, VA (US)

( * ) Notice: Subject to any disclaimer, the term of this patent is extended or adjusted under 35 U.S.C. 154(b) by 0 days.

(21) Appl. No.: 17/024,283

(22) Filed: Sep. 17, 2020

(51) Int. Cl.
*F41H 3/00* (2006.01)
*F41H 13/00* (2006.01)

(52) U.S. Cl.
CPC ..... *F41H 13/0075* (2013.01)

(58) Field of Classification Search
CPC ..... F41H 13/0075; F41H 13/0068
See application file for complete search history.

(56) References Cited

U.S. PATENT DOCUMENTS

| | | | | |
|---|---|---|---|---|
| 10,044,465 | B1 * | 8/2018 | Hetsko | B64D 45/0031 |
| 10,237,012 | B2 | 3/2019 | Morrow et al. | |
| 2016/0190859 | A1 * | 6/2016 | Blum | F41C 33/029 348/372 |
| 2017/0192089 | A1 * | 7/2017 | Parker | G01S 13/88 |
| 2018/0058826 | A1 * | 3/2018 | Podgorski | H01Q 19/17 |
| 2018/0234203 | A1 * | 8/2018 | Hsiao | G08B 13/24 |
| 2019/0101366 | A1 | 4/2019 | Hyman | |
| 2019/0120600 | A1 | 4/2019 | Holihan et al. | |

FOREIGN PATENT DOCUMENTS

| | | |
|---|---|---|
| KR | 10-1969431 | 4/2019 |
| KR | 10-2006545 B1 | 8/2019 |

OTHER PUBLICATIONS

Datasheet Antenna Measurement RF Amplifier Unit, 2 pages (downloaded Dec. 8, 2019).

Electronic Warfare and Radar Systems Engineering Handbook, Power Density—RF Cafe; <https://www.rfcafe.com/references/electrical/ew-radar-handbook/power-density.htm>, 4 pages, downloaded Feb. 4, 2020.

PHASER Microwave Weapon—The Air Force is Deploying PHASER, "The Air Force is Deploying Its First Drone-Killing Microwave Weapon," <https://www.popularmechanics.com/military/weapons/a29198555/phaser-weapon-air-force/>, 12 pages, downloaded Dec. 8, 2019.

* cited by examiner

*Primary Examiner* — Arman B Fallahkhair
(74) *Attorney, Agent, or Firm* — Banner & Witcoff, Ltd.

(57) ABSTRACT

Systems, methods and apparatus are described for a HERF weapon that may emit high-energy radio waves at a target based on locational information and a frequency associated with the target. The HERF weapon may receive the frequency and locational information from a sensing system. The HERF weapon may emit a high energy pulse toward the target and on the frequency associated with the target to disable or destroy the target without affecting nearby devices. The HERF weapon may allow the user to avoid detection by using a frequency that corresponds to the target's operating frequency.

18 Claims, 5 Drawing Sheets

DIRECTIONAL HIGH-ENERGY RADIO FREQUENCY WEAPON

BACKGROUND

A directed energy weapon (DEW) may direct high-intensity radio waves, a laser, microwaves, and/or particle beams toward at a target. Such targets may include any device with electronic circuitry including, for example, unmanned aerial vehicles (UAV) and/or unmanned ground vehicles (UGVs). DEW devices may disrupt or destroy a target by overloading the target's electronic circuits with excessive energy causing the target to lose data and/or crash. These broad spectrum DEW devices may lack precision and may also disrupt or destroy unintended electronic devices in the surrounding area. Additionally, due to the broad spectrum of energy emitted, using such DEW devices may broadcast a location of the DEW device to hostile forces, putting the DEW device and any operator of the DEW device at risk for counterattack.

SUMMARY

This Summary is provided to introduce a selection of some concepts in a simplified form as a prelude to the Detailed Description. This Summary is not intended to identify key or essential features.

A high energy radio frequency (HERF) weapon may emit high-energy radio waves at a target using locational and frequency information associated with the target. The HERF weapon may receive the frequency and locational information regarding a UAV or other target from a passive surveillance system. The HERF weapon may send directed radio frequency (RF) energy in the LOB on the specific frequency associated with the target. Directing RF energy toward the target and at a specific frequency may disable and/or destroy the target without affecting nearby devices, thereby mitigating collateral damage. Emitting RF energy at frequencies limited to targets, rather than emitting broad spectrum RF energy, may allow the HERF weapon to avoid detection.

These and other features are described in more detail below.

BRIEF DESCRIPTION OF THE DRAWINGS

Some features are shown by way of example, and not by way of limitation, in the figures of the accompanying drawings and in which like reference numerals refer to similar elements.

DETAILED DESCRIPTION

Figure 1:
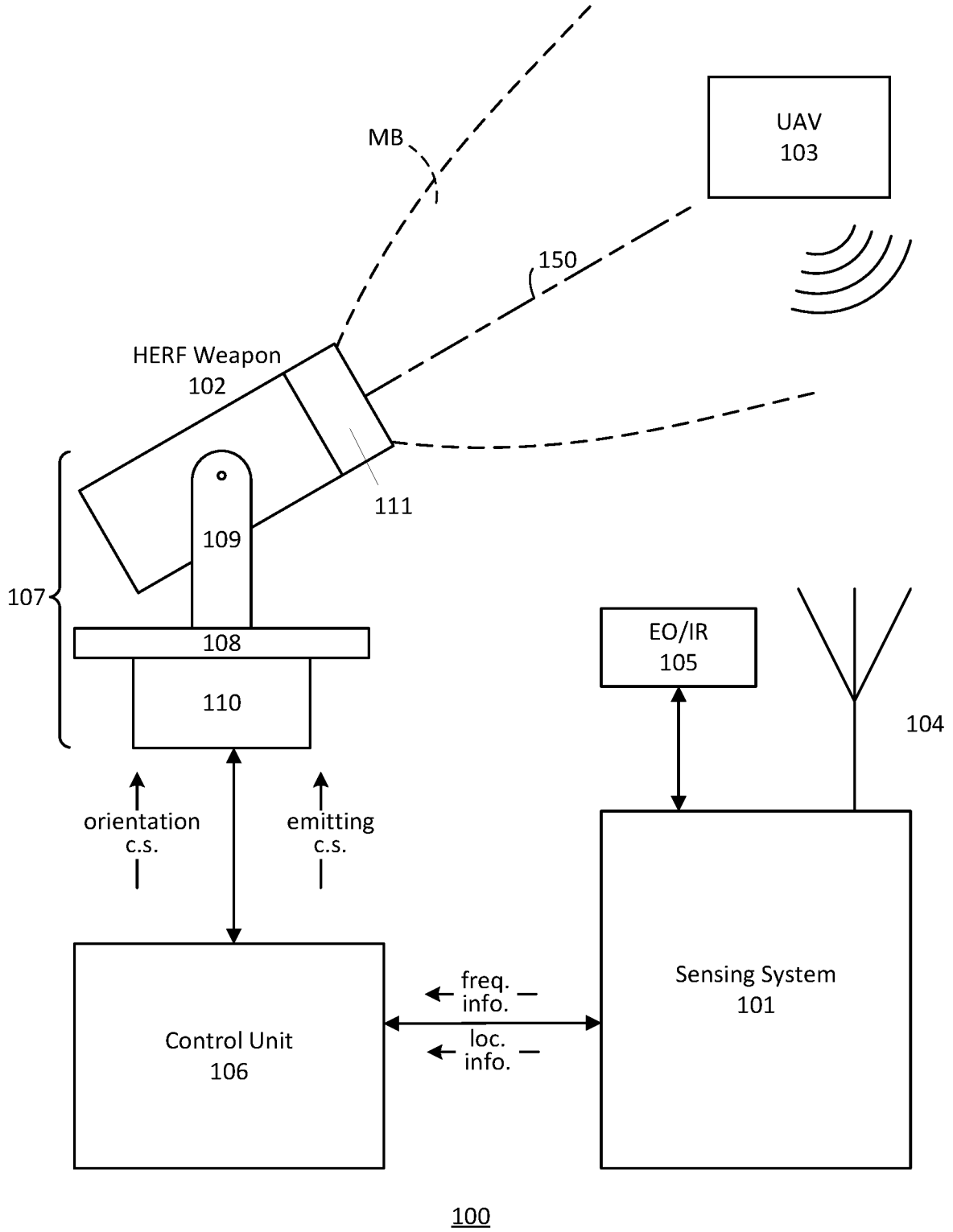
FIG. 1 is a block diagram of an example HERF weapon system for detecting a UAV and for disabling and/or destroying the detected UAV.

The accompanying drawings, which form a part hereof, show examples of the disclosure. It is to be understood that the examples shown in the drawings and/or discussed herein are non-exclusive and that there are other examples of how the disclosure may be practiced.

FIG. 1 shows an example HERF weapon system 100 in which features described herein may be implemented. The HERF weapon system 100 may be in a fixed location. The HERF weapon system 100, or portions thereof, may be mobile and may be located, for example, on a land vehicle, an aircraft, or a ship. Additionally, or alternatively, the HERF weapon system 100 (or portions thereof) may be portable and/or carried by a human operator.

The HERF weapon system 100 may comprise a sensing system 101 and one or more weapons, such as a HERF weapon 102. The sensing system 101 may comprise one or more computing device(s) configured to receive and process signals and information regarding a target (e.g., a UAV) and send information regarding the target to a control unit 106 associated with the HERF weapon 102. A computing device may comprise one or more processors and memory storing instructions that, when executed by the one or more processors, may cause the computing device to perform functions described herein. The sensing system 101 may comprise, for example, the Titan3 defense system available from Citadel Defense Company.

The sensing system 101 may be configured to collect intelligence regarding targets, such as a UAV 103, to assist in assessing the threat level of, and/or elimination of, the target. The UAV 103 may be any type of unmanned aerial vehicle including, for example, an autonomous UAV operated by an onboard computer, a UAV remotely controlled from the ground, a UAV with or without a payload, a multi-rotor UAV, a single rotor UAV, a fixed wing UAV, a fixed wing hybrid UAV, a hobbyist UAV, a commercial UAV, a military UAV, etc.

A UAV may be configured to transmit and/or receive communications in one or more frequency bands, such as for example, 2.4 GHz, 5.8 GHz, unlicensed 900 MHz and UHF bands, 5030-5091 MHz for terrestrial control links, or 10.95-30.0 GHz for satellite control systems. The communication frequency(ies) of a UAV may be constant, may change automatically or may be changed by a control signal. UAVs may be configured to operate as a single unit or as a coordinated group of UAVs (e.g., a swarm). UAVs that operate as a coordinated group may be configured to operate at the same frequency.

The sensing system 101 may be co-located with the HERF weapon 102. For example, the sensing system 101, the HERF weapon 102, and/or other components shown in FIG. 1 (e.g., the control unit 106 and/or the mounting system 107) may be contained and/or attached to a common frame or other structure. Also or alternatively, the sensing system 101 may be located remotely from the HERF weapon 102, the mounting system 107, and/or the control unit 106. Although one sensing system 101 and one HERF weapon 102 are shown in FIG. 1, a HERF weapon system may comprise multiple sensing systems and/or multiple HERF weapons (and/or multiple control units and/or mounting systems). Components of the HERF weapon system 100 may be powered by batteries and/or by other power sources.

The sensing system 101 may comprise and/or be configured to receive signals from an antenna 104, an electro-optical/infra-red (EO/IR) system 105, and/or any other sensor devices that may detect the UAV 103. The antenna 104 may comprise a directional antenna, a multi-directional antenna and/or an omni-directional antenna. Although only one antenna 104 is shown in FIG. 1, the sensing system 101 may include any number of antennas. When multiple antennas are employed, the antennas may be located separately or may be co-located as an antenna array. The antenna 104 may be configured to receive and/or emit signals. The antenna 104 may be configured to monitor one or more radio frequencies for signals and send the signals to the sensing system 101. The frequencies may be monitored continuously or on demand. The frequencies may also be monitored based on input from a user. The EO/IR system 105 may be co-located with the sensing system 101 or may be located apart from the sensing system 101. The EO/IR system 105 may comprise visual and/or infrared sensors and may comprise one or more cameras, including regular, low-light and/or night vision cameras, thermal imaging sensors, and the like. The EO/IR system 105 may be configured to detect the UAV 103, and send information about the UAV 103 to the sensing system 101, including for example, video, images and/or thermal scans of the UAV 103. The EO/IR system 105 may also be configured to assist in determining locational information regarding the UAV and/or to track any identified targets to assess the threat level associated with the target. The EO/IR system 105 may comprise, for example, a system configured to detect a UAV and/or determine locational information for the UAV using one or more cameras. Examples of such systems are described, for example, in U.S. patent application Ser. No. 16/779,917, titled "Detecting Target Objects in a 3D Space" and filed Feb. 3, 2020, which application is incorporated by reference herein.

Based on detecting a signal emitted from the UAV 103, or detecting the UAV 103 visually, the sensing system 101 may be configured to receive information from the antenna 104, the EO/IR system 105, and/or any other sensor devices. The sensing system 101 may be configured to utilize the information regarding the UAV 103 to determine a type of equipment associated with the detected signal and/or one or more frequencies of the signal. The sensing system 101 may also be configured to determine locational information for the UAV 103 using radiolocation, triangulation, trilateration, multilateration, GSM localization, geolocation, and/or other known methods of locating a signal transmitter. Locational information may, for example, comprise coordinates in 3D space, range, direction, angle of arrival (AoA) of a signal from a UAV (e.g., azimuth and elevation angles), line of bearing (LOB) to a UAV (e.g., azimuth and elevation angles), speed of travel, and/or course of travel.

The sensing system 101 may be configured to determine a range to the UAV 103 using any known method of range finding. The sensing system 101 may, for example, comprise a laser range finder. The sensing system 101 may also be configured to determine an altitude of the UAV 103, an azimuth to the UAV 103, and/or a line of bearing of the UAV 103. A LOB may have an altitude (e.g., elevation) component and an azimuth component. The sensing system 101, if not co-located with the HERF weapon 102, may be configured to account for differences in locations of the sensing system 101 and the HERF weapon 102 and determine a LOB to the UAV 103 from the HERF weapon 102.

The sensing system 101 may be configured to display, via an output device (e.g., display screen) information about the UAV 103 and/or signals from the UAV 103. The sensing system 101 may also be configured to receive input from a user or operator via an input device (e.g., keyboard, mouse, touchscreen). An operator may be able to select signals of interest for further processing, select video and/or images for further inspection, select signals and/or targets for tracking, and/or select targets for elimination. The operator may be able to control the antenna 104, EO/IR system 105, and or other types of sensor devices, to seek additional information regarding a potential target to assist in assessing a threat level of a target.

The sensing system 101 may be in communication with the control unit 106 of the HERF weapon 102 and may be configured to automatically send information to the control unit 106 regarding the UAV 103. That information may comprise frequency information indicating frequencies of signals transmitted from and/or received by the UAV 103. Also or alternatively, that information may comprise locational information indicating a LOB and/or other locational information for the UAV 103 (e.g., relative the HERF weapon 102). An operator may also or alternatively be able to manually direct the sensing system 101 to send information regarding the UAV 103 to the control unit 106. The control unit 106, which may be co-located with or remote from the HERF weapon 102, may comprise a display and/or may be configured to receive input from a user or operator.

The HERF weapon 102 may be mounted on, or otherwise connected to, a mounting system 107 that allows the HERF weapon 102 to be moved and aimed at the UAV 103 based on locational information from the sensing system 101. The mounting system 107 may comprise a base 108, one or more weapon mount(s) 109, and/or one or more servo motor(s) 110. The base 108 may be configured to rotate 360 degrees or less than 360 degrees. The base 108 may comprise one or more gimbals to allow 360 degrees of rotational movement and/or hemispherical movement of the base 108. The HERF weapon 102 may be pivotally mounted on the weapon mount 109. The one or more servo motors 110 may configured to control rotation of the base 108 and/or pivoting of the HERF weapon 102 within the weapon mount 109 based on orientation control signals from the control unit 106.

The control unit 106 may be configured to receive and/or process the frequency and locational information for the UAV 103, received from the sensing system 101, for use in aiming the HERF weapon 102 at the UAV 103 and/or in controlling frequency of output from the HERF weapon 102. Based on the received locational information, the control unit 106 may be configured to send orientation control signals to the servo motors 110 that cause the mounting system 107 to orient the HERF weapon 102 toward the UAV 103. For example, the control unit 106 may use the locational information to determine orientation control signals that will cause the servo motors 110 to orient the HERF weapon 102 so that a beam axis 150, corresponding to a main beam MB of an antenna 111 of the HERF weapon 102, is pointed toward or near UAV 103 (e.g., so that the beam axis 150 is aligned with a LOB of the UAV relative to the HERF weapon 102).

The control unit 106 may be configured to process frequency information, received from the sensing system 100, and determine a frequency (or range of frequencies) for RF energy to be emitted by the HERF weapon 102, as the main beam MB, while oriented to toward the UAV 103. The determined frequency or range of frequencies may, for example, comprise a spectrum bandwidth based on signals output by the UAV 103. Examples of spectrum bandwidths that may be determined comprise+/−1% of a frequency of signals output by the UAV 103. The control unit may be further configured to send an emitting control signal, to the HERF weapon 102, that causes the HERF weapon 102 to output RF energy at the determined frequency or frequency range.

The HERF weapon 102 may be configured to receive the emitting control signal from the control unit 106 and to generate, based on that emitting control signal, an RF energy at the frequency (or over the frequency range) indicated by the emitting control signal. The HERF weapon 102 may be further configured to output the generated RF energy via an antenna 111. The antenna 111 may comprise a directional antenna. The antenna 111 may comprise a parabolic antenna, a helical antenna, a yagi antenna, log-periodic antenna, a horn antenna, a corner reflecting antenna, a phased array antenna, or other type of antenna. The antenna 104 may also be configured to receive signals and act as an antenna (e.g., in conjunction with or instead of the antenna 104) for the detection system 101.

To reduce risk of the HERF weapon 102 being located by hostile forces, the antenna 111 may be a directional antenna that concentrates emissions along the beam axis 150 of the main beam MB and that minimizes emissions in other directions. For example, a field of view (FOV) of the main beam MB may be centered on the beam axis 150 and be approximately 20 degrees (e.g., 20 degrees, +/−5 degrees). Within that FOV, the energy output by the HERF weapon 102 may have sufficient power to disable a UAV with an effective range of the HERF weapon 102. Outside that FOV, the power output of the HERF weapon may fall off substantially.

To disable the UAV 103, the HERF weapon 102 may output RF energy that will, if received by the UAV 103, result in voltages and/or currents that damage and/or destroy reception and/or other circuitry of the UAV 103. The power of the RF energy output by the HERF weapon 102 may, for example, be at least 30 decibel-milliwatts (dBm) under operational atmospheric conditions and at a range of 1.0 to 1.5 kilometers from the HERF weapon 302 along the main beam axis 150. Operational atmospheric conditions may, for example, comprise air temperatures between −50° C. and 50° C. and humidity of up to 100%. Operational atmospheric conditions may also comprise the presence of fog and/or precipitation (rain or snow).

Figure 2:
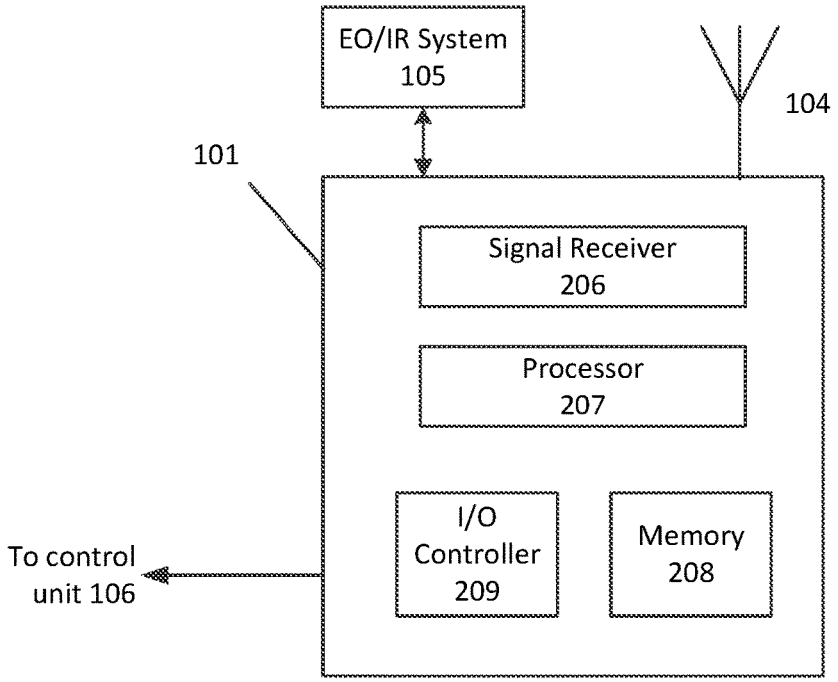
FIG. 2 is a block diagram showing additional details of a sensing system shown as part of the example system of FIG. 1.

FIG. 2 is a block diagram showing additional details of the sensing system 101. The sensing system 201 may comprise a signal receiver 206, one or more processor(s) 207, memory 208, and one or more I/O controller(s) 209. The signal receiver 206 may include any of various types of receivers such as, without limitation, RF receivers. The signal receiver 206 may comprise one or more amplifiers (e.g., one or more RF amplifiers, low noise amplifiers, IF amplifiers, AF amplifiers, etc.), tuners, mixers, buffers, oscillators, demodulators, and/or other components. The signal receiver 206 may receive RF signals and process those signals to determine or extract information regarding the signals. The processor(s) 207 may include any of various types of computational devices such as, without limitation, programmable microprocessors. The processor(s) 207 may execute instructions that cause the sensing system 101 to perform one or more operations such as are described herein. The memory 208 may include any of various types of non-transitory machine-readable storage media such as, without limitation, random access memory (RAM), read-only memory (ROM), FLASH memory, magnetic tape or discs, optical discs, etc. The memory 208 may comprise volatile and/or non-volatile memory. The I/O controller(s) 209 may include hardware and/or software that allow user input devices (e.g., a keyboard, a mouse, a touch screen) to communicate data to processor(s) 207. The I/O controller(s) 209 may also include hardware and/or software that allow user output devices (e.g., display screens, printers) to output user-understandable information based on data from the processor(s) 207. The I/O controller(s) 209 may further include hardware and/or software that allow processor(s) 207 to communicate with processors of other computing devices (e.g., the control unit 106) via one or more types of wired or wireless networks, such as for example, Ethernet adaptors and Wi-Fi adaptors (e.g., operating in accordance with one or more IEEE 802.11 WLAN standards).

The memory 208 may store software that provides instructions to processor(s) 207 that, when executed by processor(s) 207, cause the sensing system 101 to perform operations such as are described herein. The software may comprise machine-executable instructions and other data, and may include both application software and operating system software. Executable instructions that cause sensing system 101 to perform operations such as are described herein may also or alternatively be stored in other forms, e g., as firmware or as hardware logic in an integrated circuit.

The sensing system 101 may be configured to monitor one or more radio frequencies. The frequencies may be monitored continuously or on demand. A user, or operator, of the sensing system may be able to configure the sensing system, or any subpart thereof. The signal receiver 206 may be configured to receive signals from the antenna 104, the EO/IR system 105, and/or other types of sensors. The signal receiver 206 may be configured to process and/or convert received signals into usable information. For example, the signal receiver 206 may be configured to filter the incoming signal to determine one or more frequencies associated with signals output by a particular UAV (e.g., the UAV 103). The processor 207(*s*) may be configured to evaluate the signals and/or information from the signal receiver 206 and determine locational information for a target. As discussed above, for example, the processor 207 may be configured to determine locational information for a target using any known methods.

The signal receiver 206 and/or processor 207 may also be configured to receive input from the EO/IR system 105. For example, the EO/IR system 105 may be configured to detect a target visually or by infrared. The EO/IR system 105 may be configured to store video and/or images of the target and send the video and/or images of the target to the sensing system 101 for processing and/or storage. The EO/IR system 205 may also be configured to determine the range, or distance, to the UAV 103. The range may be determined using any known means, such as laser, radar, sonar, LIDAR, ultrasonic, optical, GPS, and the like. The range may also be determined by a rangefinder (not shown) which may be separate from the EO/IR system 205 that may be configured to send the range data to the EO/IR system 205 and/or to the sensing system 101. The I/O controller 209 may be configured to interface with the signal receiver 206, the EO/IR system 105, the rangefinder, and/or other sensors to track the UAV 103.

The sensing system 101 may be configured to display information about a target (e.g., a UAV such as the UAV 103). The displayed information may comprise one or more of frequency information regarding signals transmitted from or received by the target, video and/or other images, and/or locational information. An operator may determine, based on the displayed information, a threat level for a target. Additionally or alternatively, the sensing system 101 may receive operator input that indicates and/or selects signals of interest that should be further evaluated. An operator may be able to control the antenna 104, EO/IR system 105, and or other types of sensor devices, to seek additional information regarding a potential target to assist in assessing a threat level of a target. For example, the operator may be able to change the direction of the antenna 104, or focus the direction or range of the other sensors. The operator may further be able to control storage of the data in memory 208.

An operator may be able to designate one or more perimeters around the sensing system 101 and/or HERF weapon 102 that may result in different actions taken by the weapon system 101. A first predetermined distance may indicate an area over which all signals are closely monitored. A second, smaller predetermined distance may indicate an area over which all targets are considered threats and should be eliminated. For example, the EO/IR system 105 may be configured to identify potential targets within a first distance, e.g., within 2 km, from a vehicle and then track the identified target to determine the whether the identified target is a threat. If the target moves within a second distance, e.g., within 1 km, from the vehicle, the EO/IR system 105 may determine that the identified target is a threat. The sensing system 201 may also be configured to combine locational information with information from a map using augmented or virtual reality technology to provide a visual representation of the target on the map and output the map to the operator.

If a target is determined to be a threat, the sensing system 101 may be configured to communicate information to the control unit 106 and/or otherwise perform actions to prepare the HERF weapon 102 for firing. The communicated information may comprise frequency information and/or locational information for the target. The frequency information may comprise one or more frequencies associated with the UAV 103. The locational information may comprise any locational information associated with the location direction of the UAV 103, including, for example, altitude, elevation, azimuth, AoA, LOB and/or other data related to the location or direction of the UAV 103 relative to the sensing system 101 and/or relative to the HERF weapon 102.

After communicating information to the control unit 106, the sensing system 101 may continue to monitor the UAV 103 to confirm whether the UAV 103 has been disabled or destroyed (e.g., after the HERF weapon 102 is fired). The sensing system 101 may confirm destruction visually or by monitoring the frequencies associated with the UAV 103. If the sensing system 101 continues to detect the UAV 103, the sensing system 101 may communicate updated frequency and/or locational information about the UAV 103 to the control unit 106 and/or otherwise take action to facilitate firing (e.g., additional firing) of the HERF weapon 102 to disable or destroy the UAV 103.

The sensing system 101 may be configured to store the information associated with the UAV 103 in memory 208. The sensing system 101 may also be configured to store the time and/or date the UAV 103 was detected along with the information associated with the UAV 103. The sensing system 101 may be configured to store an indication as to whether the UAV 103 was disabled or destroyed. The sensing system 101 may also, or alternatively, be in communication with a network storage device and may be configured to send the information associated with the UAV 103 to the network storage device for storage.

Figure 3A:
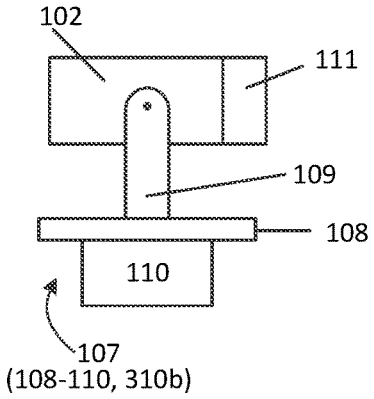
FIGS. 3A, 3B, 3C, and 3D are block diagrams showing additional details of a HERF weapon and mounting system shown as part of the example system of FIG. 1.

FIGS. 3A-3D are block diagrams showing different views and additional details of the HERF weapon 102 and the mounting system 107. FIG. 3A is a side view of the HERF weapon 102. The HERF weapon 102 may be pivotally mounted on the weapon mount(s) 109 and tiltable through a range of elevation angles. The weapon mount(s) 109 may be of any shape and/or style that allows the HERF weapon 102 tilt (e.g., about horizontal axes). The weapon mount(s) 109 may be connected directly, or indirectly, to the base 108. The base 108 may be operatively connected to the motor 110 and may be configured to rotate (e.g., about a vertical axis). The motor 110 may be configured to receive orientation control signals from the control unit 106 and, based on those received signals, rotate, or pan, the base 108. Panning and tilting allow orientation of the HERF weapon to aim the beam axis 150 at the UAV 103 by, for example, aligning the beam axis 150 with a LOB to the UAV 103.

Figure 3B:
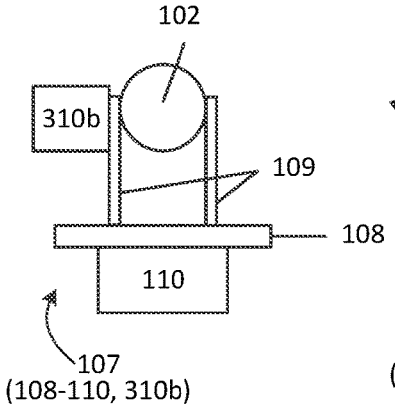
Figure 3C:
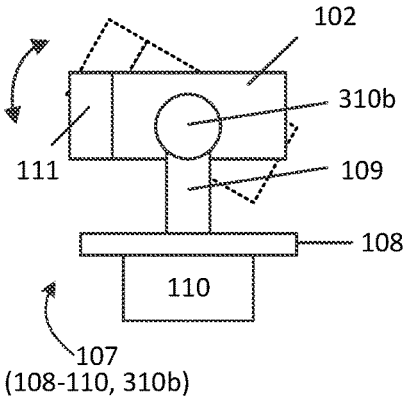
Figure 3D:
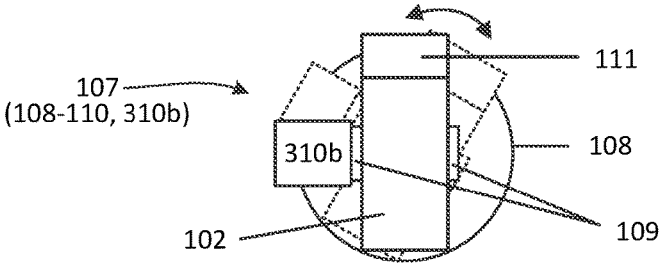

FIG. 3B is a rear view of the HERF weapon 102 and the mounting system 107 and shows a motor 310*b* configured to control tilt of the HERF weapon 302. The motor 310*b* may be configured to receive control signals from the control unit 106 and, based on those received signals, tilt the HERF weapon 102 up and down. FIG. 3C a side view of the HERF weapon 102 and the mounting system 107 from a side opposite to that shown in FIG. 3A. In FIG. 3C, a tilted position of the HERF weapon 102 is shown by a dashed line. FIG. 3D is a top view of the HERF weapon 102 and the mounting system 107. In FIG. 3D, a panned position of the HERF weapon 102 is shown by a dashed line. The HERF weapon 102 may be simultaneously panned and tilted to aim at the UAV 103.

Figure 4:
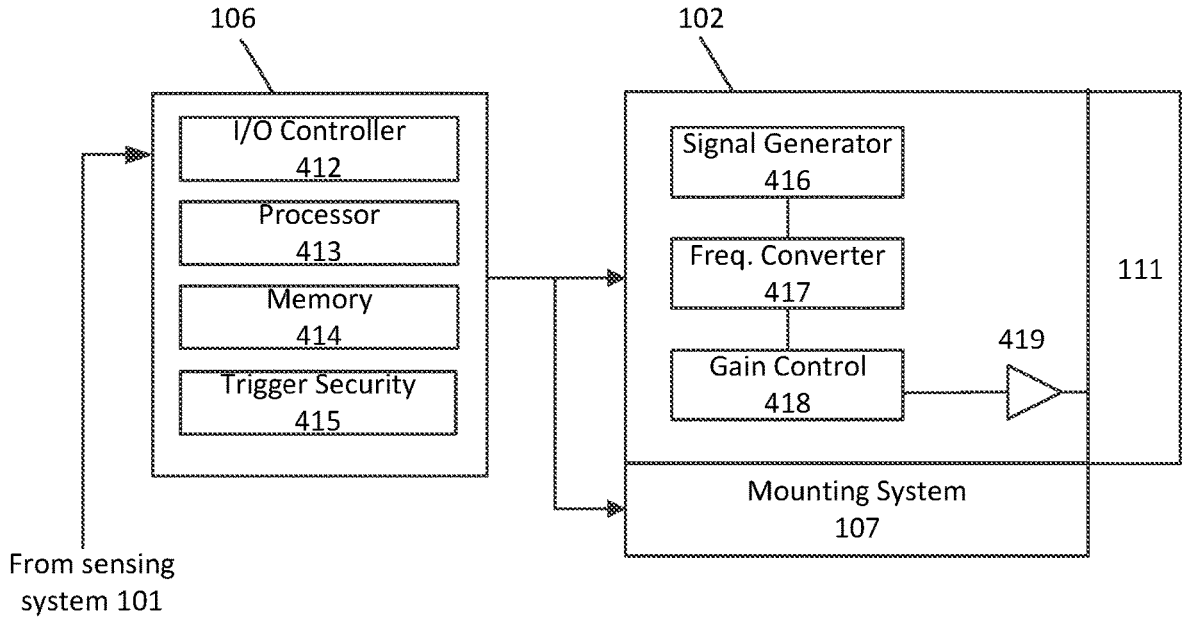
FIG. 4 is a block diagram showing additional details of the HERF weapon and mounting system shown as part of the example system of FIG. 1.

FIG. 4 is a block diagram showing additional details of the control unit 106 and the HERF weapon 102. The control unit 106 may comprise one or more I/O controller(s) 412, one or more processor(s) 413, memory 414, and a trigger security system 415. The memory 414 may comprise hardware components similar to those described for the memory 208 and may be store software that provides instructions to processor(s) 413 that, when executed by processor(s) 413, cause the control unit 106 to perform operations such as are described herein. The software may comprise machine-executable instructions and/or other data, and may include both application software and operating system software. Executable instructions that cause the control unit 106 to perform operations such as are described herein may also or alternatively be stored in other forms, e g., as firmware or as hardware logic in an integrated circuit.

The I/O controller(s) 412 may comprise hardware components similar to those described for the I/O controller(s) 209 and may be configured to communicate with and/or receive signals from the sensing system 101 and pass the communication/signals to the processor(s) 413. The I/O controller(s) 412 may use a two-way wired, wireless, or optical link to communicate signals and/or control information. The I/O controllers(s) 412 may also be configured to receive operator input via an input device (e.g., keypad, keyboard, mouse, touchscreen). The processor(s) 413 may comprise hardware components similar to those described for the processor(s) 207 and may be configured to execute instructions (e.g., stored in the memory 414) that cause that control unit 106 to carry out operations such as those described herein. The processor(s) may also be configured to generate and/or cause display information to the operator regarding the target on a display device (not shown).

The processor(s) 413 may be configured to receive signals from the sensing system 101 via the I/O controller(s) 412 and to generate control signals to orient the HERF weapon 102 (e.g., in preparation for firing). The signals received from the sensing system 101 may comprise locational information for the UAV 103, such as, for example, the LOB from the HERF weapon 102 to the UAV 103 and/or the range to the UAV 103. Based on the locational information, the processor 413 may be configured to determine mechanical adjustments (e.g., pan and tilt) to the mounting system 107 to aim the HERF weapon 102 at the UAV 103. The processor(s) 413 may be further configured to generate and send one or more orientation control signals to the mounting system 107 to orient the HERF weapon 102 based on the determined mechanical adjustments. The signals received from the sensing system 101 may also comprise frequency information for the UAV 103. Based on the frequency information, the processor 413 may be configured to generate and send one or more emitting control signals, to the HERF weapon 102, that causes the HERF weapon 102 to emit an RF signal at a frequency associated with the UAV 103. The processor(s) 413 may be configured to store the frequency and/or locational information regarding the UAV 103 in the memory 414 for storage. Such frequency and/or locational information may be stored until the target has been destroyed, or may be maintained in memory the 414 (e.g., for creating a log of the targets and/or emissions of the HERF weapon 402).

The trigger security system 415 may be configured to prevent unauthorized use of the HERF weapon 102. For example, the trigger security system 415 may comprise an input device (e.g., a keypad, keyboard, key switch, mouse, touchscreen, fingerprint or other biometric reader, etc.) for entering or confirming identification or authorization credentials (e.g., physical key, password, ID number, fingerprint etc.). Information entered into the trigger security system may be stored in the memory 414. The trigger security system 415 may prevent unauthorized access to the HERF weapon 102 and/or may maintain a record of who authorized the HERF weapon 102 to be fired.

The HERF weapon 102 may comprise, in addition to the antenna 111, a signal generator 416, a frequency converter 417, a gain control 418, and/or one or more amplifier(s) 419. The signal generator 416 may comprise an RF source and may be configured to receive signals from the control unit 106. The signal generator may be configured to generate a pulse of energy at an output power level based on the received signal(s). The output power level may be a default, or predetermined, output power level or may be determined based on the range of the UAV 103 from the HERF weapon 102. The signal generator 416 may also be configured to generate signals at a range of frequencies. The signal generator 416 may further be configured to send the generated signal(s) to the frequency converter 417. The frequency converter may comprise a transmit/receive RF head and may be configured to receive the generated signal(s) and may convert the frequency of the signal(s) up or down based on the frequency information received from the control unit 106. Additionally, or alternatively, the HERF weapon 402 may receive a signal from the UAV 103 via the antenna 111. The signal generator 416 may further comprise a phase-locked loop and may be configured to match of the frequency of the received signal from the UAV 103.

The gain control 418 may be configured to adjust or maintain the power of the output signal. The gain control 418 may adjust the power based on the range to the target and/or the perceived threat level of the target. For example, if the UAV 103 is identified as a low risk threat, the power of the RF signal output from the HERF weapon 102 may be adjusted to cause a positive voltage gain, or increased voltage, in the UAV 103 to disrupt or disable the UAV 103 without destroying it. If the UAV 103 is identified as high risk, the power of the RF signal output from the HERF weapon 102 may be adjusted to cause a positive current gain, or increased amperage, in the UAV to damage electronic traces in the UAV 103 circuitry, and thereby destroy the UAV 103.

The amplifier(s) 419 may comprise any of a variety of commercially available RF amplifiers. The amplifier 419 may be configured to increase the power of the output signal based on the gain control 418. The amplifier 419 may be located within, or separate from, the signal generator 416.

The antenna 111 may be configurable, for example, by adjusting an antenna aperture. A narrow physical and/or effective aperture provides a more focused emitted signal to more effectively eliminate a signal target. Additionally, or alternatively, drone swarms may operate on the same frequency. By widening the aperture, the swarm may be targeted as a whole.

The HERF weapon 102 may be configured to emit RF output via the antenna 111 automatically after set up is complete or based on the operator activating a trigger or entering a trigger command to the HERF weapon and/or to the control unit 106. The HERF weapon 102 may be configured to emit a RF signal pulse, multiple pulses, or a continuous RF signal (e.g., until a kill is confirmed). By emitting a signal at or near the operating frequency of the UAV 103, the HERF weapon 102 signature may be masked from discovery by hostile forces. Because the frequency of the emitted signal matches the frequency already in use by the UAV 103, the operator of the UAV 103 may not recognize the signal emitted from the HERF weapon 102 as being different from signals emitted by the UAV 103.

Figure 5A:
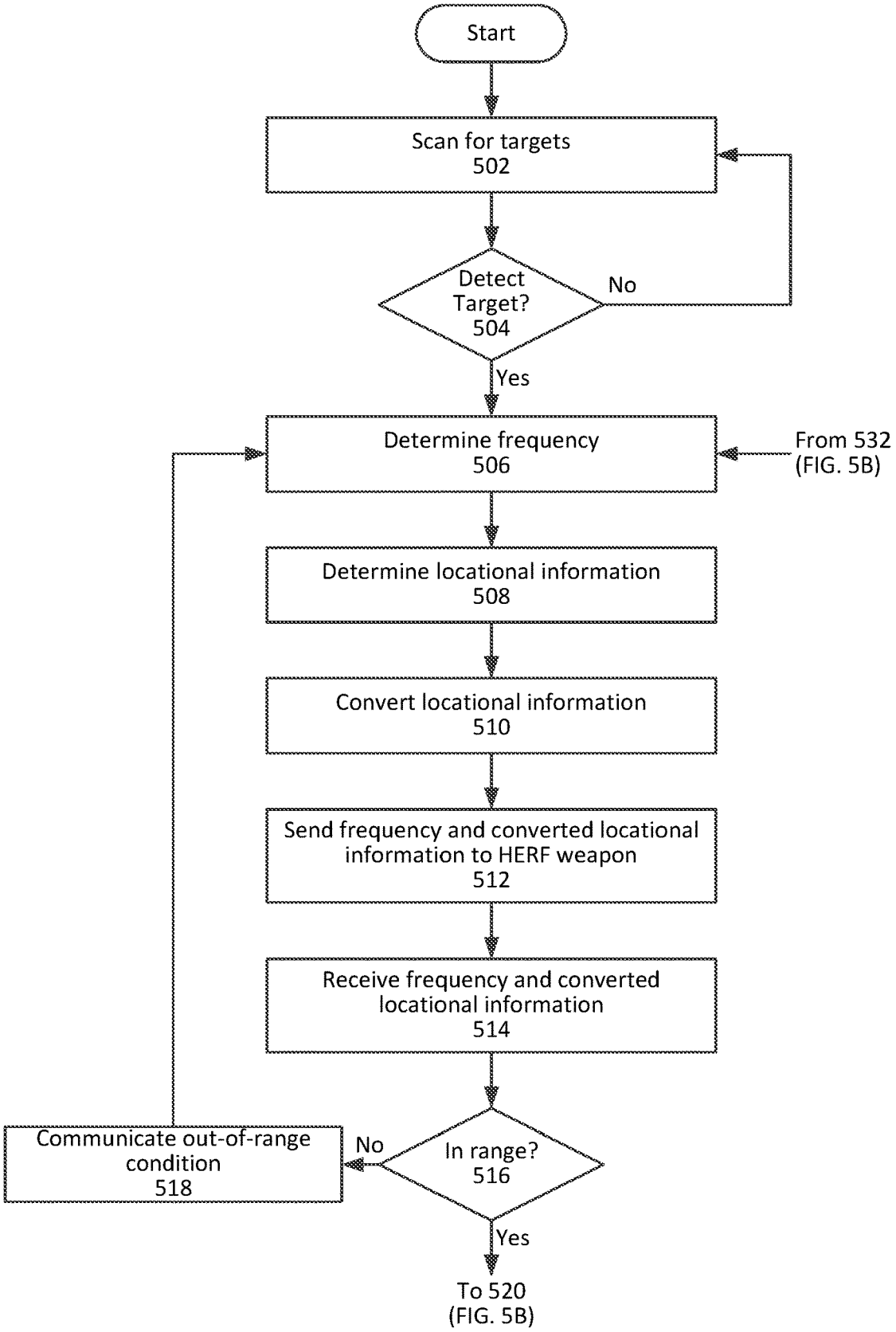
FIGS. 5A and 5B are a flow chart showing an example method for detecting, gathering information regarding, disabling, and/or destroying a potential target.
Figure 5B:
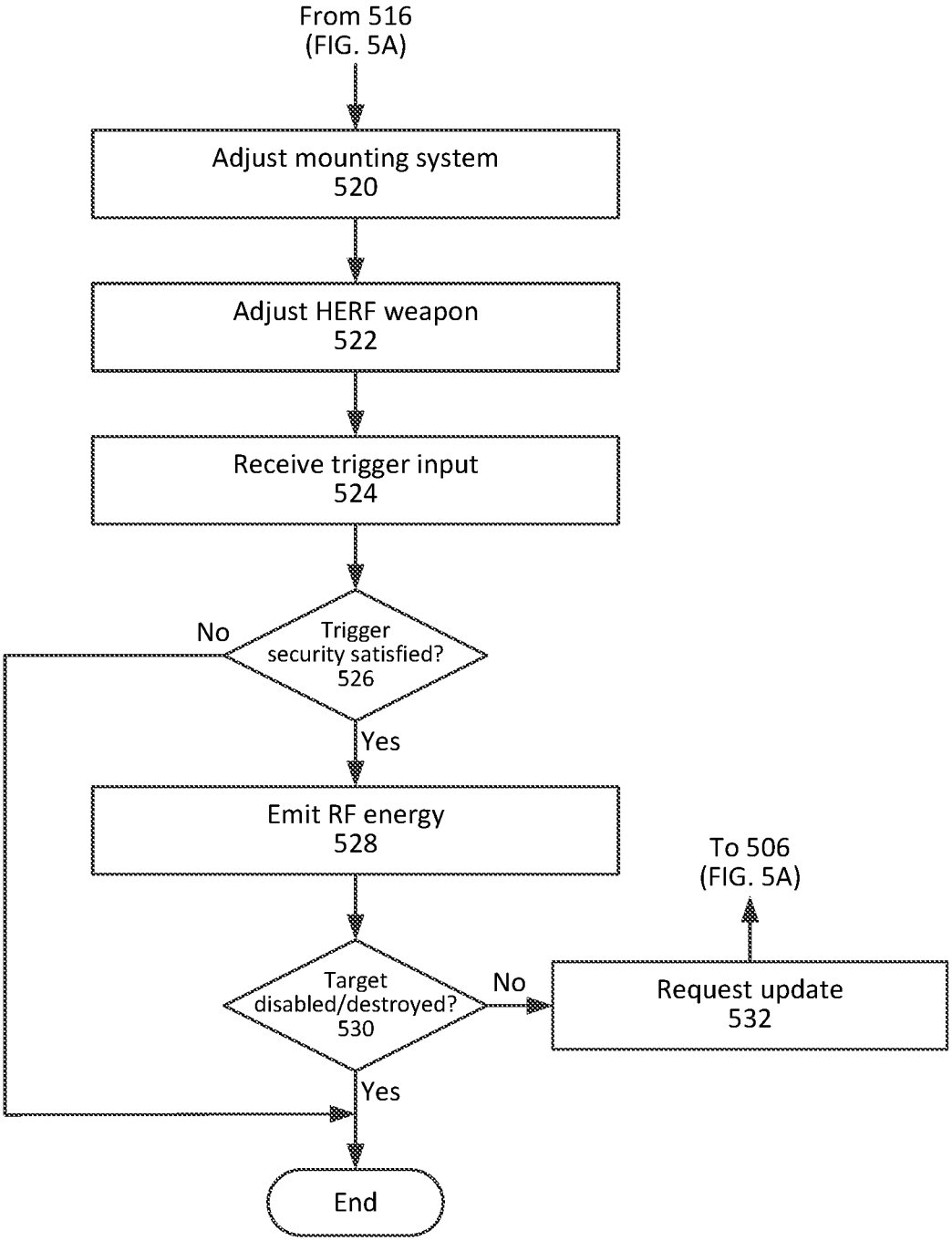

FIGS. 5A and 5B are a flow chart showing an example method for detecting, gathering information regarding, disabling, and/or destroying a potential target (e.g., the UAV 103 and/or other targets or potential targets). As explained below, some steps of the example method may be performed by the sensing system 101 and other steps of the method may be performed by the control unit 106 and/or the HERF weapon 102. The method of FIGS. 5A and 5B may be subdivided and/or performed as separate methods. One, some, or all of the steps shown in FIGS. 5A and 5B may also, or alternatively, be performed by one or more other elements in the system of FIG. 1. For example, the sensing system 101 and the control unit 106 could be combined into a single computing device. The steps shown in FIGS. 5A and 5B and/or one or more other steps may be performed based on execution, by one or more processors of one or more computing devices, of instructions that are stored in a computer-readable medium, such as a non-transitory computer-readable memory. The steps shown in FIGS. 5A and 5B need not all be performed in the order described or shown, and/or some steps may be omitted and/or otherwise changed. Additional steps may be added.

In step 502, the sensing system 101 may monitor signals received from one or more input devices, such as one or more antennas (e.g., antenna 104) and/or one or more EO/IR systems (e.g., EO/IR system 105), to scan for potential targets. In step 504, the sensing system 101 may detect a target, such as the UAV 103. If a target is not detected, the sensing system 101 may continue to scan for potential targets. If the UAV 103 is detected, the sensing system 101 may, in step 506, analyze the information from the input devices and determine one or more frequencies on which the UAV 103 is operating. In step 508, the sensing system 101 may determine locational information for the UAV 103. For example, the sensing system 101 may use data from the one or more input devices to determine locational information associated with the UAV 103 using triangulation, radio location, and/or other methods of locating a signal transmitter. As part of step 508, the sensing system 101 may determine the elevation and/or azimuth of the UAV 103, and/or the sensing system 101 may further be configured to determine a range to the UAV 103. As part of step 508, the sensing system may determine (e.g., based on multiple positions over time) a course of travel and/or speed of the UAV 103. In step 510, the sensing system 101 may (e.g., if the sensing system 101 and the HERF weapon 102 are not co-located) convert locational information regarding the UAV (e.g., location, range, AoA, LOB, course, and/or speed) of the UAV 103 relative to the sensing system 101 to locational information (e.g., location, range, AoA, LOB, course, and/or speed) of the UAV 103 relative to the HERF weapon 102. The conversion of step 510 may, for example, be based on position data (e.g., global positioning system (GPS) coordinates) associated with the sensing system 101 and on position data associated with the HERF weapon 102.

In step 512, the sensing system 101 may send, to the control unit 106 of the HERF weapon 102, the frequency information from step 506 and the converted locational information from step 510. The control unit 106 may receive that information in step 514. In step 516, the control unit 106 may determine (e.g., based on the locational information) if the UAV 103 is within range (e.g., 1 km, 1.5 km, or other value). If the UAV 103 is not in range, the control unit 106 may in step 518 communicate the out-of-range condition to the sensing system 101 and cause steps 506-514 to be repeated. If the UAV 103 is in range, the control unit 106 may, in step 520 (FIG. 5B), send a control signal to the mounting system 107 to adjust the mounting system 107 and orient (e.g., aim) the HERF weapon 107. The control signal sent in step 520 may be based on the converted locational information received in step 514. The control signal sent in step 520 may comprise a series of control signals that causes the mounting system 107 to continuously move so as to track the UAV 103 (e.g., by keeping the UAV 103 within the FOV of the HERF weapon 102 as the UAV moves relative to the HERF weapon 102). In step 522, the control unit 106 may send a control signal, to the HERF weapon 102, that configures the signal generator 416, the frequency converter 417, the gain control 418, and/or other components of the HERF weapon 102 to generate a signal that matches the operating frequency of the UAV 103. The control signal sent in step 522 may be based on the frequency information received in step 514. In step 524, the HERF weapon 102 may receive a trigger input. The trigger input may be manual at the HERF weapon 102 (e.g., a traditional firearm trigger, toggle switch, button, etc.) or at the control unit 106 (e.g., pushing a button, input through a control screen, etc.). In step 526, the trigger security system may confirm that an authorization input (e.g., a password, a physical key, etc.) allowing firing of the HERF weapon 102 was previously received (e.g., when activating the HERF weapon 102 and/or when disengaging a safety switch). If the authorization input is not confirmed, the process may end without the HERF weapon 102 being fired. If the authorization input is confirmed, the HERF weapon 102 may in step 528 emit one or more RF pulses at the power and frequency(ies) configured based on the control signals of step 522, and while the HERF weapon 102 is in the orientation resulting from the control signals of step 520. In step 530, the control unit 106 may determine, or may receive a signal from the sensing system 101 indicating, whether the UAV 103 was disabled or destroyed (e.g., a signal indicating whether or not the UAV 103 is still operating). If the UAV 103 was not disabled or destroyed, the control unit 106 may in step 532 communicate with the sensing system 101 to request an update of frequency information for the UAV 103 and/or of locational information regarding the UAV 103. The communication of step 532 may cause the sensing system 101 to repeat steps 506-512. If the UAV 103 is determined in step 530 to have been disabled or destroyed, the process may end.

As indicated above, one or more of the steps in FIGS. 5A and 5B may be performed in another order, performed by a different device, otherwise modified, or omitted. For example, in one embodiment, the sensing system 101 may not need to convert locational information determined by the sensing system 101 (e.g., in step 508) into locational information relative to a position of the HERF weapon 102. As indicated above, the HERF weapon 102 and the sensing system 101 may be co-located, and locational information determined by the sensing system 101 may thus not require conversion. As another example, step 510 may instead be performed by the control unit 106 based on the locational information determined in step 508, based on position data (e.g., GPS coordinates) for the sensing system 101, and based on position data for the HERF weapon 102.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

The invention claimed is:

1. A method for directing high-intensity beams toward an unmanned aerial vehicle (UAV), the method comprising:

receiving locational information associated with the UAV and radio frequency (RF) information associated with the UAV;

orienting, based on the locational information, a beam axis of a directional antenna toward the UAV;

adjusting, based on the locational information, an aperture of the directional antenna;

emitting, via the directional antenna, an RF signal:

comprising a frequency based on the RF information, wherein the frequency is over a spectrum bandwidth of detected transmissions from the UAV; and having a power, along the beam axis and at a range of at least 1 kilometer from the directional antenna, of at least 30 decibel-milliwatts (dBm); and creating, after emitting the RF signal, a log entry comprising an identification of the UAV and a record of the emitted RF signal.

2. The method of claim 1, further comprising:

receiving, after the emitting, an indication that the UAV is still operating;

emitting, based on the indication that the UAV is still operating, a second RF signal having a power, on the beam axis and at a range of at least 1 kilometer from the directional antenna, of at least 30 decibel-milliwatts dBm.

3. The method of claim 2, wherein the indication that the UAV is still operating is based on a visual confirmation of the UAV after the emitting of the RF signal.

4. The method of claim 2, wherein the indication that the UAV is still operating is based on detecting the RF information associated with the UAV after the emitting of the RF signal.

5. The method of claim 1, wherein the directional antenna has a field of view of approximately 20 degrees.

6. The method of claim 1, wherein the directional antenna comprises a parabolic antenna, a helical antenna, a yagi antenna, a log-periodic antenna, a horn antenna, or a phased array antenna.

7. The method of claim 1, wherein the spectrum bandwidth is within +/−1% of a second frequency of the detected transmissions.

8. The method of claim 1, wherein the orienting the beam axis of the directional antenna comprises sending control signals to cause movement of a mounting system of the antenna.

9. The method of claim 1, further comprising:

determining, based on the locational information, that a range to the UAV satisfies a threshold, and wherein the emitting the RF signal comprises emitting, based on the determining that the range satisfies the threshold, the RF signal.

10. The method of claim 1, further comprising:

receiving second locational information relative to a sensing system; and determining the locational information by converting the second locational information relative to the directional antenna, wherein the sensing system and the directional antenna are not co-located.

11. The method of claim 1, further comprising adjusting the power of the RF signal based on at least one of: a range to the UAV or a perceived threat associated with the UAV.

12. A system for directing high-intensity beams toward an unmanned aerial vehicle (UAV), the system comprising:

a directional antenna comprising a beam axis;

a radio frequency (RF) signal generator and amplifier configured to cause emission, via the directional antenna, of RF signals; and a control unit comprising one or more processors and memory storing instructions that, when executed by the one or more processors, cause the control unit to:

receive locational information associated with an unmanned aerial vehicle (UAV) and RF information associated with the UAV;

output, based on the locational information, first control signals to orient the beam axis of the directional antenna toward the UAV;

adjust, based on the locational information, an aperture of the directional antenna;

output, based on the RF information, second control signals to cause the RF signal generator and amplifier to cause emission, via the directional antenna, of an RF signal:

comprising a frequency based on the RF information, wherein the frequency is over a spectrum bandwidth of detected transmissions from the UAV; and having a power, along the beam axis and at a range of at least 1 kilometer from the directional antenna, of at least 30 decibel-milliwatts (dBm); and create, after the emission of the RF signal, a log entry comprising an identification of the UAV and a record of the emission.

13. The system of claim 12, wherein the directional antenna has a field of view of approximately 20 degrees.

14. The system of claim 12, wherein the directional antenna comprises a parabolic antenna, a helical antenna, a yagi antenna, a log-periodic antenna, a horn antenna, or a phased array antenna.

15. The system of claim 12, wherein the spectrum bandwidth is within +/−1% of a second frequency of the detected transmissions.

16. The system of claim 12, further comprise a mounting system coupled to the directional antenna, and wherein the instructions, when executed by the one or more processors, cause the control unit to output the first control signals by outputting control signals to the mounting system.

17. The system of claim 12, wherein the instructions, when executed by the one or more processors, cause the control unit to:

determine, based on the locational information, that a range to the UAV satisfies a threshold; and output the second control signals by outputting, based on a determination that the range satisfies a threshold, the second control signals.

18. The system of claim 12, wherein the instructions, when executed by the one or more processors, cause the control unit to:

receive, after the output of the second control signals, an indication that the UAV is still operating; and output, based on the indication that the UAV is still operating, additional control signals to cause the RF signal generator and amplifier to cause emission, via the directional antenna, of a second RF signal having a power, along the beam axis and at a range of at least 1 kilometer from the directional antenna, of at least 30 decibel-milliwatts (dBm).

* * * * *